US007760180B2

(12) United States Patent
Shimatani

(10) Patent No.: US 7,760,180 B2
(45) Date of Patent: Jul. 20, 2010

(54) DRIVE CIRCUIT, OPERATION STATE DETECTION CIRCUIT, AND DISPLAY DEVICE

(75) Inventor: Atsushi Shimatani, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 1441 days.

(21) Appl. No.: 11/128,390

(22) Filed: May 13, 2005

(65) Prior Publication Data

US 2005/0264510 A1 Dec. 1, 2005

(30) Foreign Application Priority Data

May 25, 2004 (JP) ..... 2004-154439

(51) Int. Cl.
*G09G 3/36* (2006.01)

(52) U.S. Cl. ..... 345/99; 345/90

(58) Field of Classification Search ..... 345/204–215, 345/690–699, 87–111, 211; 315/169.1–169.2, 315/169.3; 330/282–284, 144
See application file for complete search history.

(56) References Cited

U.S. PATENT DOCUMENTS 5,600,066 A * 2/1997 Torregrosa ..... 73/514.18
6,020,787 A * 2/2000 Kim et al. ..... 330/279
6,121,839 A * 9/2000 Giacomini ..... 330/264
2001/0013851 A1* 8/2001 Hashimoto et al. ..... 345/91
2002/0175692 A1* 11/2002 Lasalandra et al. ..... 324/684
2003/0080934 A1* 5/2003 Ishiyama ..... 345/100
2003/0151581 A1* 8/2003 Suyama et al. ..... 345/98
2004/0135599 A1* 7/2004 Kim ..... 327/78

FOREIGN PATENT DOCUMENTS

JP 3-166589 A 7/1991
JP 7-135452 A 5/1995
JP 11-085113 3/1999
JP 2000-295044 10/2000

OTHER PUBLICATIONS

Japanese Office Action dated Sep. 8, 2009 with partial English-language translation.

* cited by examiner

*Primary Examiner*—Chanh Nguyen
*Assistant Examiner*—Long Pham
(74) *Attorney, Agent, or Firm*—McGinn IP Law Group, PLLC

(57) ABSTRACT

According to an aspect of the invention, there is provided a drive circuit for driving a capacitive load. The drive circuit comprises an amplification circuit for amplifying an input signal and outputting the amplified signal to the capacitive load and an operation state detection circuit for detecting an operation state of output operation to the capacitive load in the amplification circuit. A variable resistor is connected between the amplification circuit and the capacitive load and changes the resistance value according to the detected operation state.

21 Claims, 8 Drawing Sheets

RELATED ART

DRIVE CIRCUIT, OPERATION STATE DETECTION CIRCUIT, AND DISPLAY DEVICE

BACKGROUND OF THE INVENTION

1. Field of the Invention

The present invention relates to a drive circuit, an operation state detection circuit, and a display device, and more particularly to a drive circuit for driving a capacitive load such as a liquid-crystal panel and to an operation state detection circuit and a display device.

2. Description of the Related Art

In recent years, liquid-crystal panels has diversified and found application in a wide variety of fields from small panels for portable games to panels for large-screen TV sets. Accordingly, it is necessary that the drive circuits for driving the liquid-crystal panels perform the desired operations under various load conditions.

Not only in the case of liquid-crystal panels of different shapes, but also when the liquid-crystal panels are of the same shape, there is manufacturing variations between liquid-crystal panels in the manufacturing process. As a result, the load conditions of drive circuits for driving the liquid-crystal panels differ for each drive line of the liquid-crystal panel, that is, for each output of the drive circuit. Furthermore, in the drive circuits, when the number of horizontal dots of the liquid-crystal panel is not divisible by the number of outputs of the drive circuits, the redundant output terminals are used in an open state, and in this case, the load conditions also differ for each output of the drive circuit. Furthermore, property evaluation of drive circuits is conducted with a tester in the manufacturing process of the drive circuits, and the load conditions during such evaluation with the tester are completely different from the load conditions of the liquid-crystal panel. Therefore, there are a variety of different load conditions of the drive circuit, and those conditions sometimes differ for each output terminal even in a single drive circuit.

An operational amplifier connected in a voltage follower fashion is generally used as an output circuit provided in the output section of such drive circuits. In the operational amplifiers, phase margin changes due to fluctuations of the load conditions of driving. If the phase margin in an operational amplifier used in a drive circuit is deteriorated, the operational amplifier starts oscillating and causing defects in the liquid-crystal panel displays. For this reason, operational amplifiers used in drive circuits are designed in consideration of all the conditions of loads to be connected to the output of the above-described drive circuits.

Phase compensation by a mirror capacitance is generally known as one means for increasing the phase margin of operational amplifiers. Phase compensation by a mirror capacitance separates the first pole and second pole of an operational amplifier to realize the desired phase characteristics. In this method the higher is the phase compensation capacitance, the larger is the phase margin. If the phase is compensated for with a capacitance value sufficient from the standpoint of the above-described fluctuations of load conditions, the phase margin of the operational amplifier increases and no oscillations occur.

However, drive circuits require low power consumption and high-load drive capability at the same time. Reduction of power consumption and improvement of high-load drive capability of the operational amplifiers used in the output circuits are mandatory conditions for reducing power consumption and improving high-load drive capability of the drive circuits. The slew rate (SR), differential stage current (Id) and phase compensation capacitance value (Cc) of an operational amplifier satisfy the relationship of the following Formula 1:

$$SR=Id/Cc \qquad \text{[Formula 1]}$$

Thus, increasing the phase compensation capacitance value in order to maintain the phase margin of an operational amplifier degrades the drive capability. In order to prevent the drive capability from being degraded, the power consumption of the operational amplifier has to be increased. In other words, from the standpoint of realizing a low power consumption and high-load drive capability, it is desired that the phase compensation capacitance value of the operational amplifier be small. A technique to connect a resistor in series to the capacitive load is known to increase the phase margin of an operational, amplifier with respect to a capacitive load.

Here, the mechanism of oscillations in an operational amplifier will be explained. FIG. 5 is a basic block-diagram of a general feedback circuit. Referring to FIG. 5, the reference numeral 24 designates an operational amplifier and the reference numeral 23 designates a feedback section. As shown in FIG. 5, in the case of feedback of the operational amplifier 24, the closed-loop voltage gain will be represented by the following Formula 2, where Ao stands for an open-loop voltage gain of the operational amplifier 24 and β stands for a feedback factor of the feedback section 23:

$$Ac=\frac{vo}{vi}=\frac{-Ao}{1+Ao\beta} \qquad \text{[Formula 2]}$$

From this formula it follows that when Aoβ=−1, that is, when |Ao|=|1/β|, if the phases of input and output are inverse, then the operational amplifier starts oscillating due to the feedback. Further, FIG. 6 shows a Bode diagram representing the frequency characteristic of the feedback circuit shown in FIG. 5. In the Bode diagram shown in FIG. 6, if the gradient difference is 40 dB/dec or higher at the point where Ao and 1/β intersect, the operational amplifier 24 oscillates at a frequency $f_o$ of the intersection point.

FIG. 7 shows a block diagram illustrating an example of the conventional feedback circuit. An operational amplifier used in the output circuit of a drive circuit, is used in a voltage follower connection as shown in FIG. 7. Referring to FIG. 7, the reference numeral 25 designates an operational amplifier, 26—an output resistance $R_o$ of the operational amplifier, 27—a resistor RL for improving the phase margin, and 28—a load capacitance CL. In this example, 1/beta is represented by the following Formula 3, and the Bode diagram assumes the shape shown in FIG. 8.

$$\frac{1}{\beta}=\frac{vo}{vi}=\frac{Ro+\left(RL+\frac{1}{sCL}\right)}{RL+\frac{1}{sCL}}=\frac{Ro+RL}{RL}\cdot\frac{\left(s-\frac{1}{CL(Ro+RL)}\right)}{\left(s-\left(-\frac{1}{CLRL}\right)\right)} \qquad \text{[Formula 3]}$$

As shown in FIG. 8, if the resistor RL is connected in series with the load capacitance CL of the operational amplifier, the phase margin is improved and the slope of 1/β decreases with the increase in the resistance value of the connected resistor RL. Thus, if the resistance value of the resistor RL increases, the gradient difference of 1/β and Ao decreases. Therefore, the effect of improving the phase margin becomes more significant.

However, as described hereinabove, the drive circuits are required to have both low power consumption and high-load drive capability at the same time. In other words, it is required to decrease power consumption and improve a high-load drive capability of operational amplifiers used in output circuits. Connecting a resistor in series to the load of the operational amplifier causes deterioration of the drive capability of the operational amplifier, and power consumption of the operational amplifier has to be increased to prevent the drive capability from deteriorating. In other words, in order to realize low power consumption and high-load drive capability, it is desirable to use a small resistance value of the resistor connected in series with the load of the operational amplifier.

A method is known in which the resistance value of the load connected to the operational amplifier is switched to satisfy the afore-described requirement. FIG. 9 is a block diagram illustrating a configuration example of a drive circuit and a display panel of the conventional liquid-crystal display device. FIG. 10 is a block diagram illustrating a configuration example of the conventional drive circuit. The explanation will be conducted below with reference to those drawings.

As shown in FIG. 9, the liquid-crystal display device comprises a control circuit 29, a gradation voltage power source 30, a scanning line drive circuit 31, a data line drive circuit 32, and a display panel 33 driven by the scanning line drive circuit 31 and data line drive circuit 32.

Here, the display panel 33 is an active matrix color liquid-crystal panel that uses thin-film MOS transistors (TFT) 38 as switch elements. In this panel, pixels are arranged in rows and columns at the intersection points of scanning lines 35 and data lines 34 provided with respective prescribed distances in the row direction and column direction. The pixel comprises the liquid-crystal capacitance 36 that is an equivalent capacitive load and TFT 38 whose gate is connected with the scanning line 35, which are connected in series between the data lines 34 and a common electrode line 37.

Scanning pulses generated by the scanning line drive circuit 31 are applied to each row of scanning line 35 of the display panel 33 based on the horizontal synchronization signals and vertical synchronization signals. In a state in which a common potential Vcom is applied to the common electrode line 37, an analog data signal generated for each color by the data line drive circuit 32 based on the digital display data is applied to each column of data line 34 of the display panel. As a result, color text or images are displayed on the display panel 33.

The data line drive circuit 32 will be described below. The data line drive circuit 32 comprises a D/A conversion circuit 39 for converting (D/A converting) respective digital signals to analog signals for display data of each column by selecting one gradation level of voltage, and an output circuit 41 changing the impedance to drive each data line 34, and outputting an analog display data signal.

As shown in FIG. 9 and FIG. 10, the output circuit 41 comprises a plurality of operational amplifiers 401 with rail-to-rail input/output and respectively connected in a voltage follower fashion, a switch 402 connected between the output Vout of the data line drive circuit 32 and output terminal Sout of the operational amplifier 401, a switch 403 connected in parallel to the switch 402, and a common bias circuit 40 for supplying a common bias voltage to the operational amplifiers 401. The switch 402 becomes a resistor of a very low resistance value (low resistor) when it is switched ON, and the switch 403 becomes a resistor of a very high resistance value (high resistor) when it is switched ON. For example, the switch 402 is switched ON when the external control signal S1 is at a low level, and the switch 403 is switched ON when the external control signal S2 is at a high level.

FIG. 11 is a timing chart illustrating the operation of the drive circuit. For example, in the t2 duration shown in FIG. 11, that is, when the operational amplifier 401 is in a load drive state, both the switch 402 of a low resistance value and the switch 403 of a high resistance value are controlled by the external control signals S1, S2 so as to be switched ON. As a result, the gradation voltage that was outputted from the D/A conversion circuit 39 and inputted to the operational amplifier 401 is inputted through the switch 402 and switch 403 into the display panel 33 and drive will be conducted to the desired voltage.

At this time, because the switch 402 and switch 403 are connected in parallel and the resistance value of the switch 402 is extremely low, the total resistance value of the output switches (switch 402 and switch 403) of the operational amplifier 401 assumes a value almost equal to the resistance value of the switch 402. For this reason, the output switch of the operational amplifier 401 has a low resistance and can have high driving capability. Reducing the resistance value of the output switch of the operational amplifier 401 realizes a high drive capability, but degrades the phase margin of the operational amplifier 401. However, when the liquid-crystal panel load is driven, the operational amplifier 401 is in a transient state and the phase margin is not required to be taken into account. For this reason, reducing the resistance value of the output switch realizes high drive capability, but causes not problems.

Further, in the durations other that t1 and t2 shown in FIG. 11, that is, when the operational amplifier 401 is in a stationary state, the first switch 402, which has a low resistance, and the second switch 403, which has a high resistance, are controlled by the external control signals S1, S2 so as to be switched OFF and ON, respectively. As a result, the gradation voltage inputted from the D/A conversion circuit 39 into the operational amplifier 401 is held and outputted via the switch 403, which has a high resistance.

As described hereinabove, connecting a high-resistance element between the output of the operational amplifier 401 and the load increases the phase margin of the operational amplifier 401 and reduces the susceptibility to the effect of load condition fluctuations. Thus, when the operational amplifier 401 is in a stationary state, the second switch 403, which has a high resistance, plays a role of the resistor for improving the phase margin. Therefore, good phase margin can be maintained even against load fluctuations.

It has now been discovered that the problem associated with the data line drive circuit 32 representing the above-described conventional technology is that the timing of the control signal for conducting switching of the resistance value is constant and can correspond only to specific load conditions in order to control identically all the outputs of the data line drive circuit 32.

With the conventional technology, the above-mentioned external control signals S1, S2 are usually timing generated according to the internal clock in a logical circuit (not shown in the figure) provided inside the data line drive circuit 32, and a plurality of the operational amplifiers 401 are controlled together thereby. Because the operation of this logical circuit is determined by the process for the fabrication of the data line drive circuit 32, the control timing of the external control signals S1, S2 is also determined at the same time.

Thus, the control timing of the external control signal S1, S2 becomes the timing designed in advance by the designer of the data line drive circuit 32 under certain assumptions relating to load conductions. Therefore, it is impossible to deal with the unexpected load conditions. For example, the slope of the output signal Vout of the output circuit 401 during load driving fluctuates according to the load conditions and the length of the load drive duration t2 also fluctuates. Therefore, when the operational amplifier 401 is designed, the design has to provide a certain spare amount for the phase margin by taking into account the spread of load conditions.

Further, the load conditions, such as the spread in load between the data lines in the process for the manufacture of the liquid-crystal panel and the difference in voltage between the outputs outputted by the output circuit 401 of the data line drive circuit 32, are different for each output of the operational amplifier. Furthermore, in the data line output circuits 32, all the outputs are sometimes not connected to the liquid-crystal panels for certain resolutions of the liquid-crystal panel.

For example, in the case of a liquid-crystal panel with an XGA (1024×768) resolution using a 384-output data line drive circuit 32, all the outputs of the data line drive circuit 32 are connected to the liquid-crystal panel by using eight data line drive circuits 32. In the case of a liquid-crystal panel with an UXGA (1600×1200) resolution, a total of 13 data line drive circuits 32 are used, but in one of the data line drive circuits 32, 192 outputs of 384 outputs are not connected to the liquid-crystal panel and used in an open state. In other words, 192 outputs of operational amplifiers 401 of data line drive circuits 32 drive the liquid-crystal panel load, which is a heavy load, and the remaining 192 outputs drive a parasitic component load, which is a light load.

In this case, with the system of controlling together a plurality of operational amplifiers 401, as in the conventional data line drive circuits 32, it is impossible to deal with the fluctuations of load conditions of each pin. Because those operational amplifiers 401 have to be designed so as to have a good phase margin under all of a variety of load conditions, the design has to provide a certain spare amount for the phase margin by taking into account this variety of load conditions.

Holding such spare amount for the phase margin of the operational amplifier 401 requires a large phase compensation capacitance. The operational amplifiers 401 of the drive circuits of display devices are arranged at a ratio of 400 or more per one chip of the data line drive circuit 32. Therefore, providing a large phase compensation capacitance for the operational amplifiers 401 hinders the increase in the degree of integration. Furthermore, a large phase compensation capacitance causes the decrease in the drive capability of the operational amplifiers 401, and the increase in power consumption is indispensable to maintain the drive capability of the operational amplifiers 401.

Furthermore, even when the external control signals are controlled independently from the data line control circuit 32, it is difficult to take into account spread of various types and usage conditions and to determine accurately the load conditions of operational amplifiers. Furthermore, wiring for control signals increases, thereby hindering the increase in the degree of integration.

Drive circuits disclosed in Japanese Unexamined Patent Publication Nos. 11-85113 (Japanese Patent No. 3488054) and 2000-295044 are known as the conventional drive circuits for liquid-crystal display devices.

Thus, the problem associated with the conventional drive circuits of the liquid-crystal display devices is that the timing of control signals for switching the resistance value is constant, the operation that can be conducted to control all the multiple outputs identically corresponds only to specific load conditions, and the phase margin and drive capability are sometimes degraded by the load conditions.

SUMMARY OF THE INVENTION

According to an aspect of the invention, there is provided a drive circuit for driving a capacitive load, comprising an amplification circuit for amplifying an input signal and outputting the amplified signal to the capacitive load, an operation state detection circuit for detecting an operation state of output operation to the capacitive load in the amplification circuit, and a variable resistor connected between the amplification circuit and the capacitive load and changing the resistance value according to the detected operation state.

With this drive circuit, the operation state of the amplification circuit that varies depending on the load conditions of the capacitive load is detected so that the resistance value between the amplification circuit and capacitive load can be switched to the adequate value according to load conditions in order to. Therefore, phase margin or driving capability of the drive circuit can be improved.

According to another aspect of the invention, there is provided an operation state detection circuit for detecting a operation state of a drive circuit for driving a capacitive load, the operation state detection circuit detecting a drive state in which the capacitive load is charged or discharged, and non-drive state in which the capacitive load is neither charged nor discharged, according to an output of the drive circuit.

With this operation state detection, the operation state of the drive circuit that varies depending on the load conditions of the capacitive load is detected correspondingly to the output of the drive circuit. Therefore, the operation state can be detected with good efficiency.

According to still another aspect of the invention, there is provided a display device comprising a display panel having a plurality of pixels and a plurality of lines for transmitting signals to the plurality of pixels, and a plurality drive circuits connected to the plurality of lines for outputting signals to the plurality of pixels. Each of the plurality of drive circuits comprises an amplification circuit for amplifying an input signal and outputting an amplified signal to the pixel via the line, an operation state detection circuit for detecting an operation state of an output operation of the amplification circuit to the capacitive load of the pixel, a variable resistor connected between the amplification circuit and the pixel and changing the resistance value according to a detected operation state.

With this display device, the operation state of the amplification circuit that varies depending on the load conditions of the capacitive load of pixels is detected so that the resistance value between the amplification circuit and capacitive load can be switched to the adequate value according to load conditions. Therefore, the phase margin or driving capability of the drive circuit can be improved and the performance of the display device can be improved.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

Embodiment 1

Figure 1:
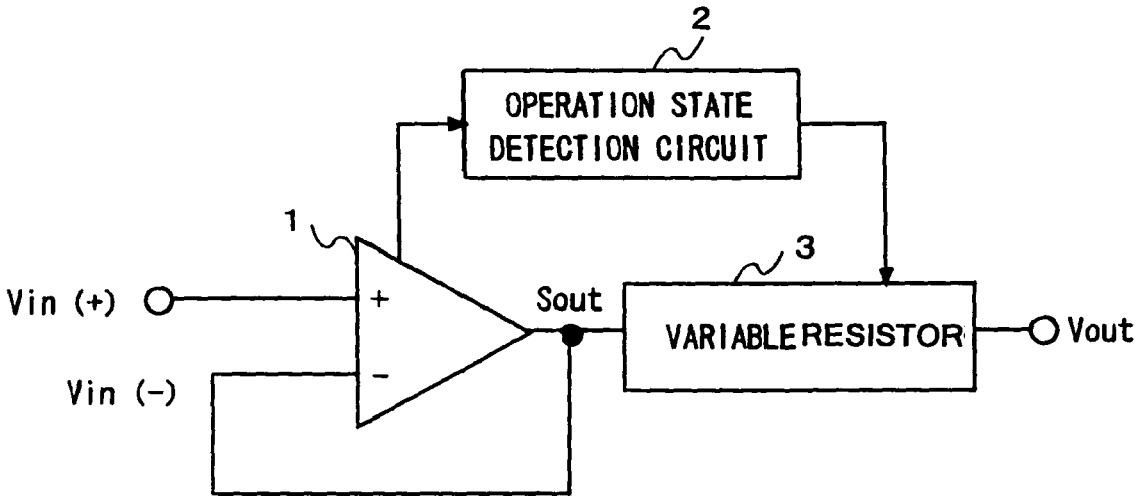
FIG. 1 is a block diagram illustrating the configuration of the drive circuit in accordance with the present invention.
Figure 2:
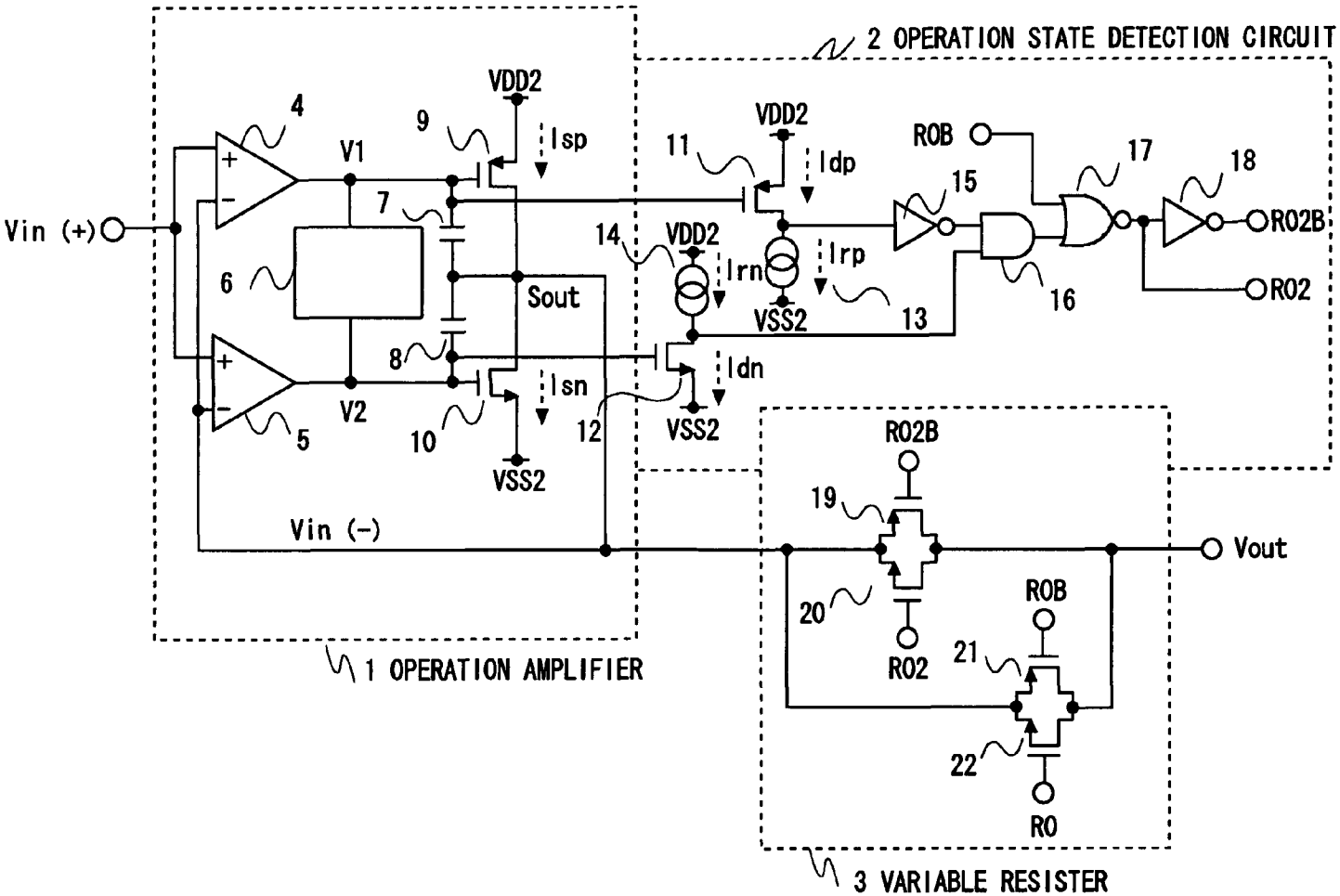
FIG. 2 is a circuit diagram illustrating the configuration of the drive circuit in accordance with the present invention.

First, the configuration of the drive circuit of Embodiment 1 of the present invention will be explained. FIG. 1 is a block diagram illustrating the outline of the configuration of the drive circuit of the present embodiment. FIG. 2 is a circuit diagram showing in great detail the configuration of the drive circuit of the present embodiment.

Figure 9:
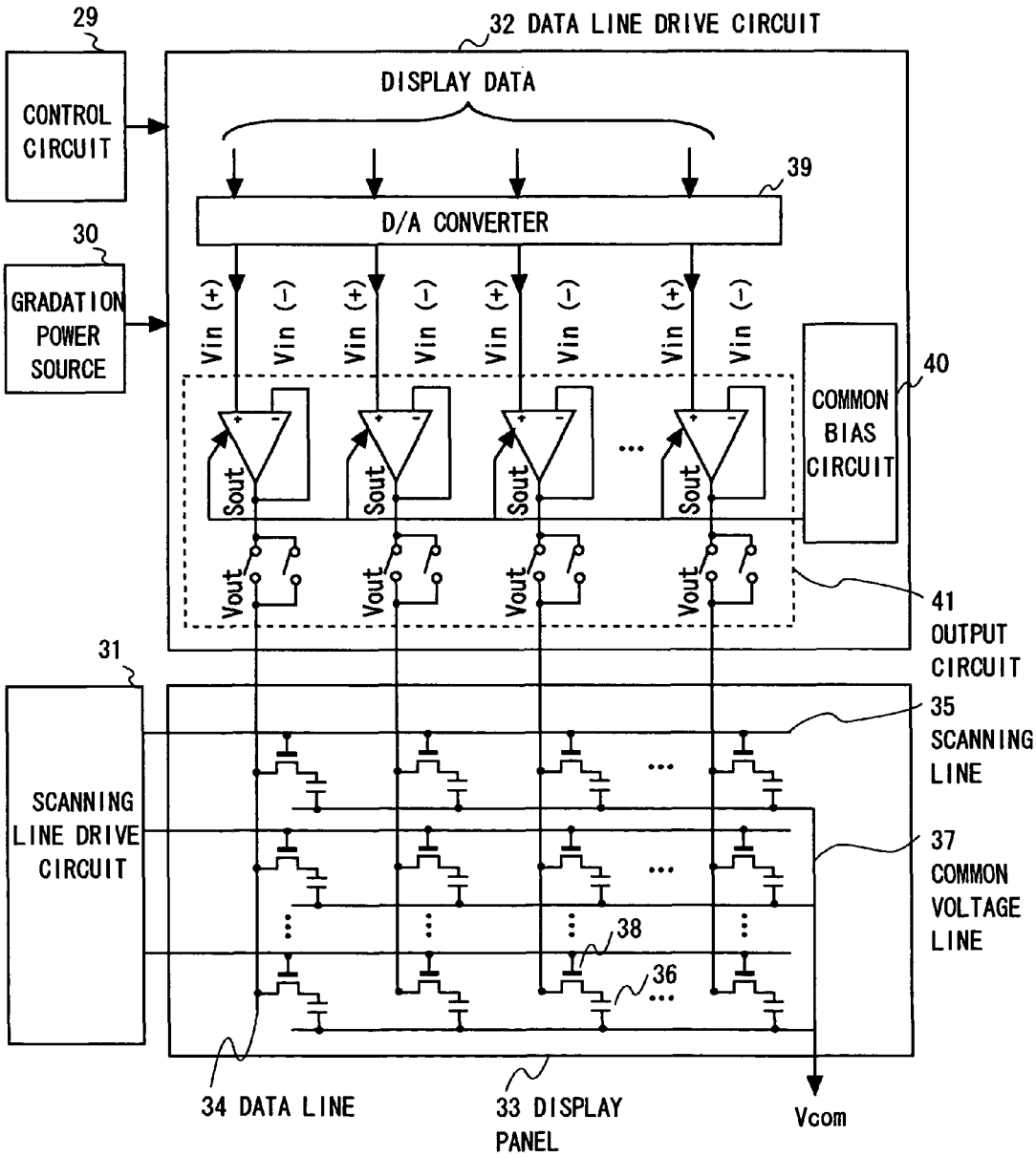
FIG. 9 is a block diagram illustrating the configuration of the conventional display device.

The drive circuit of the present embodiment is a drive circuit for driving a capacitive load. This drive circuit is used, as shown in FIG. 9, as an output circuit 41 of a data line drive circuit 32 for driving a display panel 33. For example, the drive circuit of the present embodiment is provided for each data line 38.

As shown in FIG. 1, the drive circuit of the present embodiment comprises an operational amplifier 1 capable of rail-to-rail input and output and connected in a voltage follower manner, an operation state detection circuit 2 connected to the operational amplifier 1, and a variable resistor 3 connected between an output terminal Vout of the drive circuit and an output terminal Sout of the operational amplifier 1 and controlled by the operation state detection circuit 2. The operational amplifier 1 amplifies the input signal and outputs the amplified signal to a capacitive load (pixels) via the variable resistor 3. The operation state detection circuit 2 detects the operation state of the output operation to the capacitive load in the operational amplifier 1. The operation state detection circuit 2 detects the operation state of the operational amplifiers 1 corresponding to the load conditions of the capacitive load by referring to the output signal of the operational amplifier 1 and performs switching of the resistance value of the variable resistor 3. Furthermore, the operation state detection circuit 2 detects whether the operation state of the operational amplifier 1 is a drive state of charging/discharging the capacitive load, or a stationary state (non-drive state) in which the capacitive load is neither charged nor discharged. The variable resistor 3 is connected between the operational amplifier 1 and the capacitive load and changes the resistance value thereof according to the operation state detected with the operation state detection circuit 2. According to the control of the operation state detection circuit 2, the variable resistor 3 reduces the resistance value when the operation state of the operational amplifier 1 is a drive state, and increases the resistance value when the operation state is a stationary state.

As shown in FIG. 2, the operational amplifier 1 comprises a first differential amplifier 4 and a second differential amplifier 5 having non-inverting input terminals Vin(+) and inverting input terminals Vin(−) thereof respectively commonly connected, a first P-channel MOS transistor (output stage transistor) 9 whose source is connected to a positive power source VDD2, drain is connected to the output terminal Sout, and gate is connected to an output terminal (node) V1 of the first differential amplifier 4, a first N-channel MOS transistor (output stage transistor) 10 whose source is connected to a negative power source VSS2, drain is connected to the output terminal Sout, and gate is connected to the output terminal (node) V2 of the second differential amplifier 5, an AB-class control circuit 6 connected between the node V1 and node V2, a first capacitor 7 connected between the node V1 and output terminal Sout, and a second capacitor 8 connected between the node V2 and output terminal Sout.

The first differential amplifier 4 and second differential amplifier 5 are provided so that signals within a range from the potential of the positive power source VDD2 to the potential of the negative power source VSS2 be in the operation region. Among the signals inputted into the input terminal Vin(+), the signals on the side of the potential of the positive power source VDD2 are amplified by the first P-channel MOS transistor 9 via the first differential amplifier 4, and the signals on the side of the potential of the negative power source VSS2 are amplified with the first N-channel MOS transistor 10 via the second differential amplifier 5. Thus, the operational amplifier 1 is a push-pull-type amplifier. The signals amplified by the operational amplifier 1 are outputted from the output terminal Sout.

The AB-class control circuit 6 is a circuit for controlling a bias current of the first P-channel MOS transistor 9 and first N-channel MOS transistor 10 so as to cause the operational amplifier 1 to operate as an AB-class amplifier. For example, when the load is charged, mainly the first P-channel MOS transistor 9 operates and the first N-channel MOS transistor 10 does not operate, but even in this case, a small bias current is passed to the first N-channel MOS transistor 10, thereby reducing the occurrence of switching distortions. Further, in order to reduce switching distortions, the operational amplifier 1 preferably operates as an AB-class amplifier, but an A-class amplifier or B-class amplifier may be used alternatively.

The first capacitor 7 and second capacitor 8 are mirror capacitors, achieving the phase compensation and improved phase margin.

The operation state detection circuit 2 comprises a second P-channel MOS transistor 11 whose source is connected to the positive power source VDD2 and whose gate is connected to the node V1, a second N-channel MOS transistor 12 whose source is connected to the negative power source VSS2 and whose gate is connected to the node V2, a first constant current source 13 connected between the positive power source VDD2 and the drain of the second P-channel MOS transistor 11, a second constant current source 14 connected between the negative power source VSS2 and the second N-channel MOS transistor 12, a first inverter 15 having an input thereof connected to the drain of the second P-channel MOS transistor 11, a first two-input AND 16 having input terminals thereof connected to the output of the first inverter 15 and the drain of the second N-channel MOS transistor 12, a first two-input NOR 17 having the input terminals thereof connected to an external control signal ROB and the output terminal of the first two-input AND 16, and a second inverter 18 having an input terminal thereof connected to the output terminal of the first two-input NOR 17. A resistance value control signal RO2 is outputted from the two-input NOR 17, and a resistance value control signal RO2B, which is an inverted signal of the resistance value control signal RO2, is outputted from the inverter 18. The resistance value control signals RO2 and RO2B are the control signals for controlling the resistance value of the variable resistor 3. If the signal levels of the resistance value control signals RO2 and RO2B are switched, the resistance value of the variable resistor 3 is switched.

Figure 10:
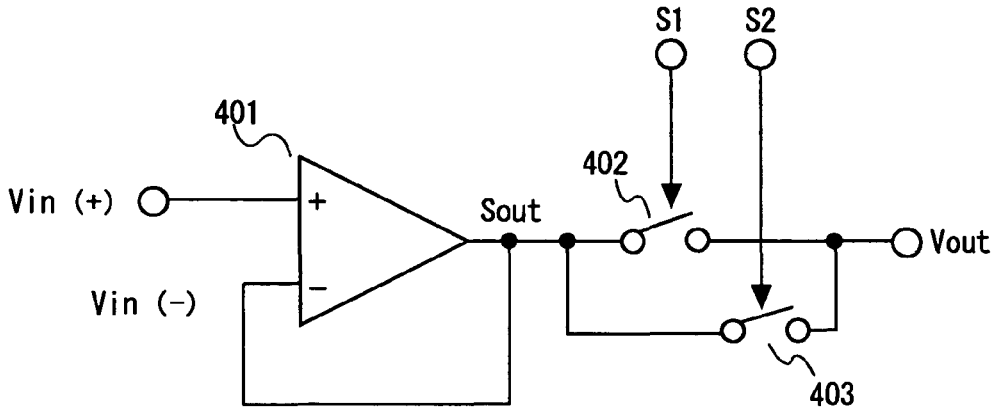
FIG. 10 RELATED ART
FIG. 10 is a block diagram illustrating the configuration of the conventional drive circuit; and, FIG. 11 is a timing chart illustrating the operation of the conventional drive circuit.
Figure 11:
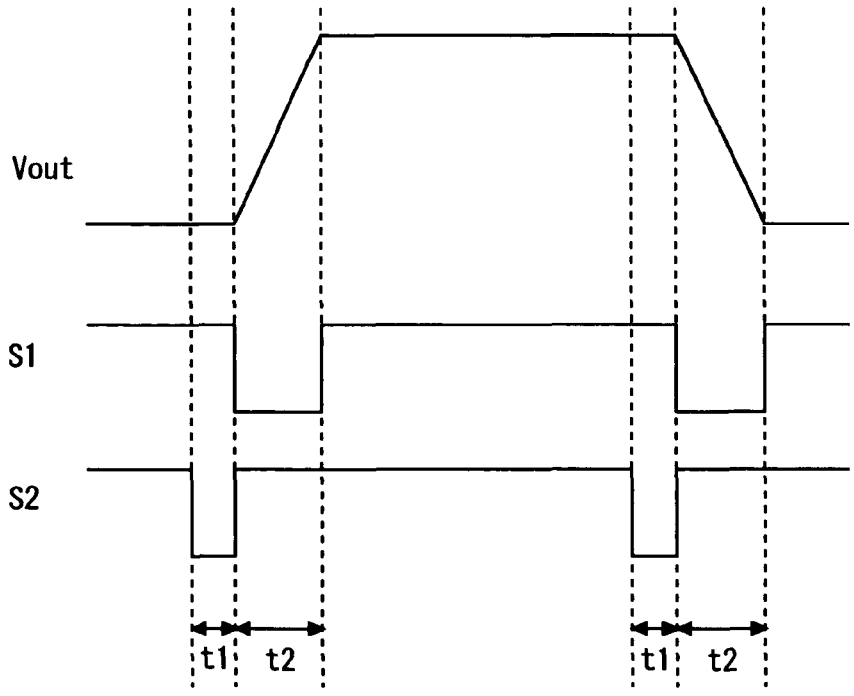

The external control signal ROB is a signal obtained by inverting the external control signal RO. The external control signals RO and ROB are the control signals generated in a logical circuit provided in the data line drive circuit 32, similarly to the external control signals S1 and S2 in the conventional circuit shown in FIG. 10. For example, the external control signals RO and ROB are generated in accordance with an internal clock.

The variable resistor 3 comprises a third P-channel MOS transistor 19 whose source is connected to the output terminal Sout of the operational amplifier 1, whose drain is connected to the output terminal Vout of the driver circuit, and which has the gate thereof connected to the resistance value control signal RO2B outputted from the operation state detection circuit 2, a third N-channel MOS transistor 20 whose source is connected to the output terminal Sout of the operational amplifier 1, whose drain is connected to the output terminal Vout of the drive circuit, and which has the drain thereof connected to the resistance value control signal RO2 outputted from the operation state detection circuit 2, a fourth P-channel MOS transistor 21 whose source is connected to the output terminal Sout of the operational amplifier 1, whose drain is connected to the output terminal Vout of the drive circuit, and which has the gate thereof connected to the external control signal ROB, and a fourth N-channel MOS transistor 22 whose source is connected to the output terminal Sout of the operational amplifier 1, whose drain is connected to the output terminal Vout of the drive circuit, and which has the gate thereof connected to the external control signal Ro.

The transistors of the variable resistor 3 are set so that the resistance values are different when the transistors are switched ON. For example, the setting is such that the resistance value attained when the third P-channel MOS transistor 19 and third N-channel MOS transistor 20 are switched ON and the resistance value attained when the fourth P-channel MOS transistor 21 and fourth N-channel MOS transistor 22 are switched ON are different. Further, the selected transistors are switched ON/OFF and the resistance value of the variable resistor 3 is changed based on the resistance value control signals RO and RO2 inputted from the operation state detection circuit 2. For example, the third P-channel MOS transistor 19 and third N-channel MOS transistor 20 are switched ON/OFF simultaneously and when they are switched ON, they operate as a resistor having the prescribed resistance value. In the same manner, the fourth P-channel MOS transistor 21 and fourth N-channel MOS transistor 22 are also switched ON/OFF simultaneously, and when they are switched ON, they operate as the resistor having the prescribed resistance value. In this example, the resistance value attained when the third P-channel MOS transistor 19 and third N-channel MOS transistor 20 are switched ON is lower than the resistance value attained when the fourth P-channel MOS transistor 21 and fourth N-channel MOS transistor 22 are switched ON.

The operation of the operation state detection circuit 2 will be described below. The first P-channel MOS transistor 9 of the operational amplifier 1 and the second P-channel MOS transistor 11 of the operation state detection circuit 2 are configured to have commonly connected sources and commonly connected gates. As a result, the drain current Idp of the second P-channel MOS transistor 11 can be represented by the following Formula 4, where W1/L1 stands for a gate size of the first P-channel MOS transistor 9, Isp stands for the drain current thereof, and W2/L2 stands for the gate size of the second P-channel MOS transistor 11:

$$Idp = \frac{L1}{W1} \cdot \frac{W2}{L2} \cdot Isp \qquad \text{[Formula 4]}$$

The first constant current source 13 connected to the drain of the second P-channel MOS transistor 11 serves to produce a flow of a constant current Irp. In this case, the second P-channel MOS transistor 11 and the first constant current source 13 serve as the first current comparator which changes its output according to the respective current values.

Further, the first N-channel MOS transistor 10 of the operational amplifier 1 and the second N-channel MOS transistor 12 of the operation state detection circuit 2 have a configuration in which the respective sources and gates thereof are commonly connected. As a result, the drain current Idn of the second N-channel MOS transistor 12 can be represented by the following Formula 5, where W3/L3 stands for the gate size of the first N-channel MOS transistor 10, Isn stands for the drain current thereof, and W4/L4 stands for the gate size of the second N-channel MOS transistor 12.

$$Idn = \frac{L3}{W3} \cdot \frac{W4}{L4} \cdot Isn \qquad \text{[Formula 5]}$$

The second constant current source 14 connected to the drain of the second N-channel MOS transistor 12 serves to produce a flow of a constant current Irn. In this case, the second N-channel MOS transistor 12 and the second constant current source 14 operate as the second current comparator changing the output according to the respective current values.

Thus, in the present embodiment, the gate size ratio between the first P-channel MOS transistor 9 and the second P-channel MOS transistor 11, and the gate size ratio between the first N-channel MOS transistor 10 and the second N-channel MOS transistor 12 are set to the predetermined values. Drain currents proportional to the gate size ratios are generated and changes in the output signal of the operational amplifier 1 are detected by the changes in the drain currents. The operation states of the operational amplifier 1 according to the state of the load connected to the operational amplifier 1 are detected by changes of the drain current. Furthermore, in the present embodiment, the gate voltage (control signal) of the first P-channel MOS transistor 9, the first N-channel MOS transistor 10 or an output signal is referred to and the operation state of the operational amplifier 1 is detected based on the referenced signal. The current (Idp, Idn) generated in accordance with this reference signal (gate voltage) is compared with the prescribed reference value (Irp, Irn) to decide whether the operation state is a drive state or a stationary state. For example, when the electric current generated in accordance with the gate voltage is larger than the prescribed reference value, a decision is made that the operation state is a drive state, and when the current is less than the prescribed reference value, the decision is made that the operation state is a stationary state.

In this example, the drain currents generated in accordance with the gate voltage of the first P-channel MOS transistor 9 and first N-channel MOS transistor 10 are compared with the reference currents, respectively, but the gate voltage may be directly compared with the reference voltage. For example, the gate voltage of the first P-channel MOS transistor 9 or first N-channel MOS transistor 10 may be inputted into an inverter and the threshold voltage of the inverter is used as a reference voltage. When the threshold voltage of the inverter is used as the reference voltage, the circuit configuration can be further simplified, but the accuracy of the threshold voltage has to be ensured.

Further, not only the gate voltage of the first P-channel MOS transistor 9 or first N-channel MOS transistor 10, but also other signals may be referred to. Any signal enabling the detection of the operation state of the operational amplifier 1 may be used. For example, the drain current Isp of the first P-channel MOS transistor 9 and the drain current Isn of the first N-channel MOS transistor 10, or the output terminal Sout of the operational amplifier 401 may be directly referred to. However, in this case, another means for detecting the level of the drain current Isp and drain current Isn or output terminal Sout is required.

Figure 3:
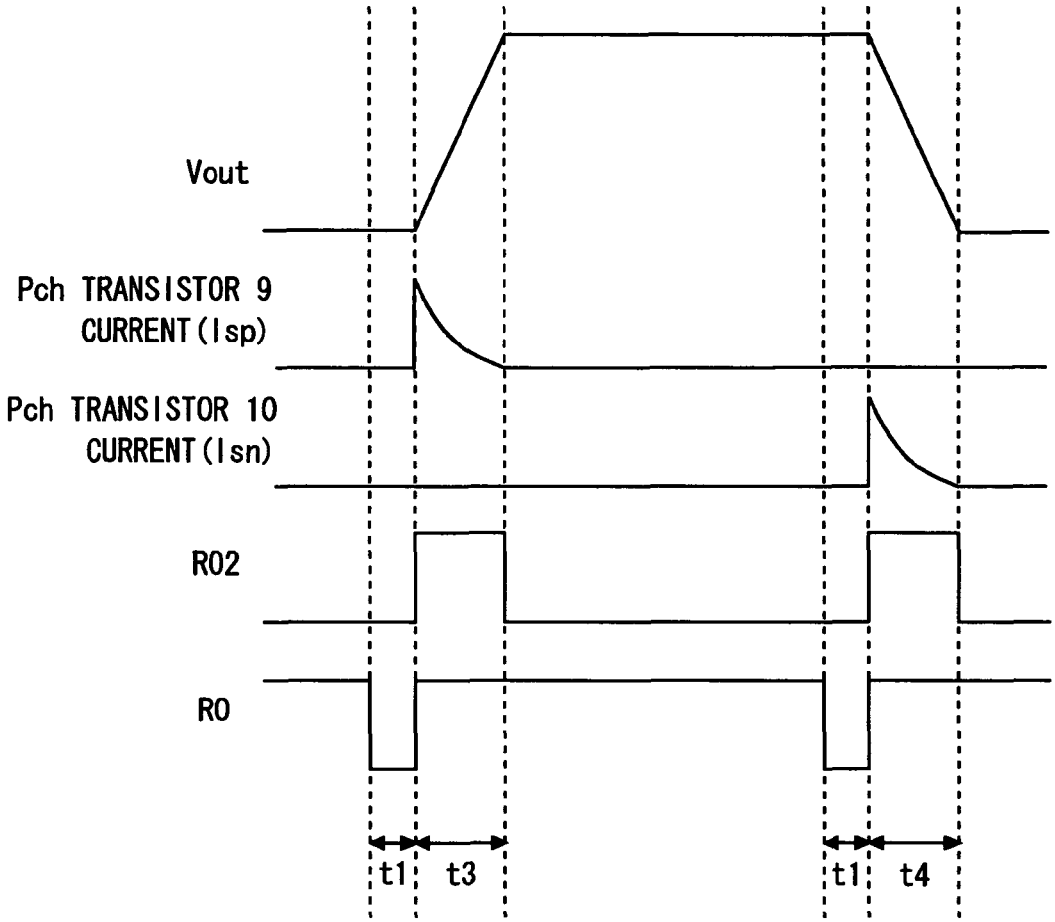
FIG. 3 is a timing chart illustrating the operation of the drive circuit in accordance with the present invention.

FIG. 3 shows a timing chart illustrating the operation of the drive circuit of the present embodiment. Referring to FIG. 3, t3 and t4 are durations in which the operational amplifier 1 is in a load drive state, t3 is a load charging duration (electric charging of the load), and t4 is a load discharging duration (electric discharging of the load). Others are durations in which the operational amplifier 1 is in a stationary state (non-drive state), and neither charging not discharging of the load is conducted within the durations. In the t1 duration, the connection of the operational amplifier 1 and load is disrupted. For example, the load charge is reset in the t1. Data between t1 and the next t1 correspond to display data.

As shown in FIG. 3, in durations other than the t3 and t4 durations, that is, when the operational amplifier 1 is in a stationary state, there is no difference between the input voltage Vin(+) and input voltage Vin(−). Therefore, the current Isp flowing in the first P-channel MOS transistor 9 is about several microamperes. As a result, the current Idp flowing in the second P-channel MOS transistor 11 also becomes about several microamperes. Further, the current value Irp of the first constant current source 13 is designed to be about several tens of microamperes. Therefore, when the operational amplifier 1 is in a stationary state, the current Irp which the first constant current source 13 acts to provide is larger than the current Idp which the second P-channel MOS transistor 11 acts to pass. As a result, the first current comparator (second P-channel MOS transistor 11 and first constant current source 13) outputs a low level.

Similarly, when the operational amplifier 1 is in a stationary state, the current Isn flowing through the first N-channel MOS transistor 10 is usually about several microamperes. As a result, the current Idn flowing through the second N-channel MOS transistor 12 becomes also about several microamperes. Further, the current value Irn of the second constant current source 14 is designed to be about several tens of microamperes. Therefore, when the operational amplifier 1 is an a stationary state, the current Irn which the second constant current source 14 acts to supply is larger than the current Idn which the second N-channel MOS transistor 12 acts to pass. As a result, the second current comparator (second N-channel MOS transistor 12 and second constant current source 14) outputs a high level.

The outputs of those first and second comparators are converted into variable resistor control signals by the inverter 15, first two-input AND 16, first two-input NOR 17, and second inverter 18, resulting in that the resistance value control signal RO2 of the output of the operation state detection circuit 2 assumes a low level and the resistance value control signal RO2B assumes a high level.

Thus, the inverter 15 receives a low level from the first current comparator and outputs a high level. Then, the first two-input AND 16 takes in a high level from the inverter 15 and second current comparator and puts out a high level. Then, the first two-input NOR 17 is applied a high level from the first two-input AND 16 and sets the resistance value control signal RO2 to a low level. Then, the second inverter 18 receives the low level from the first two-input NOR 17 and sets the resistance value control signal RO2B to a high level.

As shown in FIG. 3, in the t3 duration, that is, during a load drive state in which the operational amplifier 1 charges the load, there appears a difference between the input voltage Vin(+) and input voltage Vin(−). As a result, the current Isp flowing in the first P-channel MOS transistor 9 rises to several hundreds of microamperes. Therefore, the current Idp flowing in the second P-channel MOS transistor 11 also rises to several hundreds of microamperes. Furthermore, the current value Irp of the first constant current source 13 is designed to several tens of microamperes. Therefore, during a load drive state in which the operational amplifier 1 charges the load, the current Irp which the first constant current source 13 acts to supply is less than the current Idp which the second P-channel MOS transistor 11 acts to pass. As a result, the first current converter outputs a high level.

Furthermore, during a load drive state in which the operational amplifier 1 charges the load, the current Isn flowing in the first N-channel MOS transistor 10 of the operational amplifier 1 is the same as that during the stationary state. Therefore, the second current comparator continues to output a high level.

The outputs of those first and second comparators are converted into variable resistor control signals by the inverter 15, first two-input AND 16, first two-input NOR 17, and second inverter 18 conducted in the same manner as described above, resulting in that the resistance value control signal RO2 is outputted at a low level when the external control signal ROB is at a high level and outputted at a high level when the external control signal ROB is at a low level. The resistance value control signal RO2B is outputted at a high level when the external control signal ROB is at a high level and outputted at a low level when the external control signal ROB is at a low level.

Thus, the inverter 15 is provided with a high level from the first current comparator and outputs a low level. Then, the first two-input AND 16 receives a low level from the inverter 15 and puts out a low level. Then, because the first two-input NOR 17 receives a low level from the first two-input AND 16, it outputs as the resistance value control signal RO2 a low level when the external control signal ROB is at a high level and outputs a high level when the external control signal ROB is at a low level. Then, the second inverter 18 outputs as the resistance value control signal RO2B a high level when a low level is presented from the first two-input NOR 17 and outputs a low level when a high level is presented from the first two-input NOR 17.

Further, because the external control signal ROB is an inverted external control signal RO, the external control signal ROB is at a high level during the t1 duration and is at a low level during the t3 duration. Therefore, within the t3 duration, RO2 is at a high level and RO2B is at a low level. Due to feedback from the output terminal Sout to the input terminal Vin(−), at the end of the t3 duration, the difference between the input voltage Vin(+) and input voltage Vin(−) disappears and the operation corresponding to that in the above-described stationary state is performed.

As shown in FIG. 3, in the t4 duration, that is, in a load drive state in which the operational amplifier 1 discharges the load, a difference appears between the input voltage Vin(+) and input voltage Vin(−). Therefore, the current Isn flowing in the first N-channel MOS transistor 10 increases to several hundreds of microamperes and, therefore, the current Idn flowing in the second N-channel MOS transistor 12 also increases to several hundreds of microamperes. Furthermore, the current value Irn of the second constant current source 14 is designed for several tens of microamperes. Therefore, in a load drive state in which the operational amplifier 1 discharges the load, the current Irn which the second constant current source 14 acts to provide is less than the current Idn which the second N-channel MOS transistor 12 acts to pass. As a result, the second current converter will output a low level.

In the load drive state in which the operational amplifier 1 discharges the load, the current Isp that flows in the first P-channel MOS transistor 9 of the operational amplifier 1 is the same as that in a stationary state. Therefore, the first current comparator still outputs a low level.

By converting those outputs of the first and second current converters into variable resistor control signals in the same manner as described above, the resistance value control signal RO2 is outputted at a low level when the external control signal ROB is at a high level and is outputted at a high level when the external control signal ROB is at a low level. The resistance value control signal RO2B is outputted at a high level when the external control signal ROB is at a high level and is outputted at a low level when the external control signal ROB is at a low level.

Further, similarly to the process described above, because the external control signal ROB is at a low level in the t4 duration, the resistance value control signal RO2 is at a high level and the resistance value control signal RO2B is at a low level in the t4 duration. Similarly to t3, after the t4 duration, the difference between the input voltage Vin(+) and input voltage Vin(−) disappears and the operation corresponding to that in the above-described stationary state is performed.

According to the output signal of the operation state detection circuit 2, the variable resistor 3 operates so as to decrease the resistance value during the load charge duration t3 and load discharge duration t4. Thus, the variable resistor 3 conducts control such that the resistance value of the output switch decreases while the resistance value control signal RO2 is at a high level and the resistance value control signal RO2B is at a low level, and conducts control so that the resistance value of the output switch increases during other durations.

For example, in a stationary state, since the external control signal RO is at a high level and the external control signal ROB is at a low level, the fourth P-channel MOS transistor 21 and fourth N-channel MOS transistor 22 are switched ON, and since the resistance value control signal RO2 is at a low level and the resistance value control signal RO2B is at a high level, the third N-channel MOS transistor 20 and third P-channel MOS transistor 19 are switched OFF. As a result, the resistance is determined only by the fourth P-channel MOS transistor 21 and fourth N-channel MOS transistor 22 and a higher resistance value is obtained.

In a load drive state, since the resistance value control signal RO2 is at a high level and the resistance value control signal RO2B is at a low signal, the third N-channel MOS transistor 20 and third P-channel MOS transistor 19 are switched ON. As a result, the resistance value becomes almost equal to that created by the third N-channel MOS transistor 20 and third P-channel MOS transistor 19 and a lower resistance value is obtained.

Thus, in the drive circuit of the present embodiment, the duration in which each operational amplifier 1 used in the output circuit of the drive circuit charges and discharges the load, that is, the duration in which the phase margin is not required to be taken into account for the operational amplifier 1 is automatically detected by the first and second current comparator, the resistance value control signal RO2 to the variable resistor 3 is controlled to a high level, the resistance value control signal RO2B to the variable resistor 3 is controlled to a low level, and the resistance value of the variable resistor 3 connected to the output of the operational amplifier 1 can be reduced. Furthermore, in the stationary state of the operational amplifier 1, that is, within the duration in which the phase margin should be taken into account, the resistance value control signal RO2 to the variable resistor 3 is controlled to a low level, the resistance value control signal RO2B to the variable resistor 3 is controlled to a high level, and the resistance value of the variable resistor 3 connected to the output of the operational amplifier 1 can be increased. As a result, even when the load driven by the drive circuit changes for each output pin, the operational amplifier of each output automatically detects it. Therefore, when the operational amplifier itself is in a load drive state, a transition to a higher drive capability can be realized by reducing the resistance of the output switch, whereas in a stationary state, a stable phase margin can be maintained by increasing the resistance of the output switch. Therefore, it is possible to deal with each and every of the above-described load variations.

Therefore, because it is not necessary to employ a design that holds a margin taking into account the load conditions of the operational amplifier, the phase compensation capacitance value of the operational amplifier can be reduced. Reducing the phase compensation capacitance of the operational amplifier means that the load can be charged and discharged rapidly at a low current, thereby enabling the reduction of power consumption and improvement of drive performance. Furthermore, reducing the phase compensation capacitance makes it possible to increase the packing density of chips for a drive circuit of a display device that requires the integration of a large number of operational amplifiers.

Embodiment 2

Figure 4:
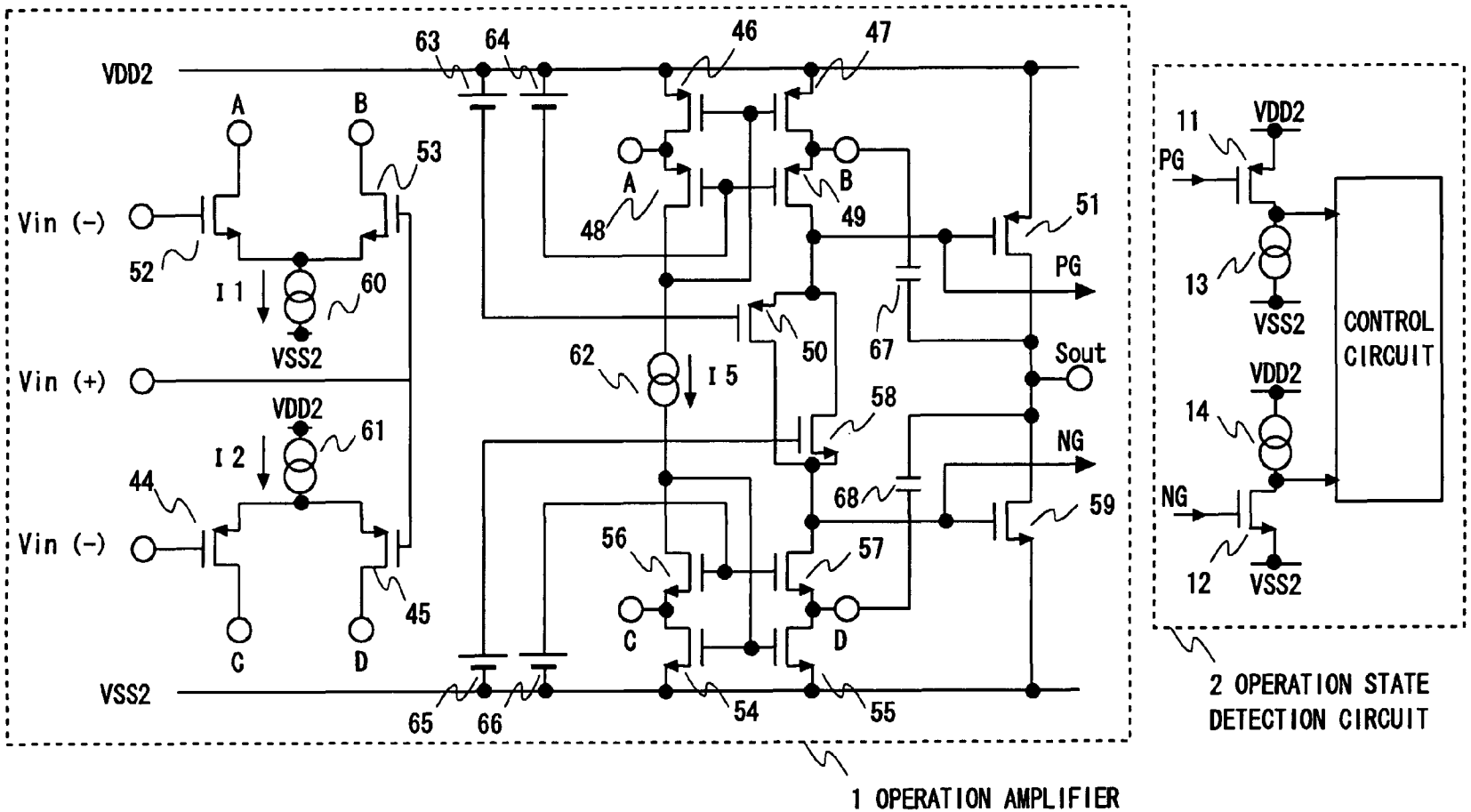
FIG. 4 is a block diagram illustrating the configuration of the drive circuit in accordance with the present invention.
Figure 5:
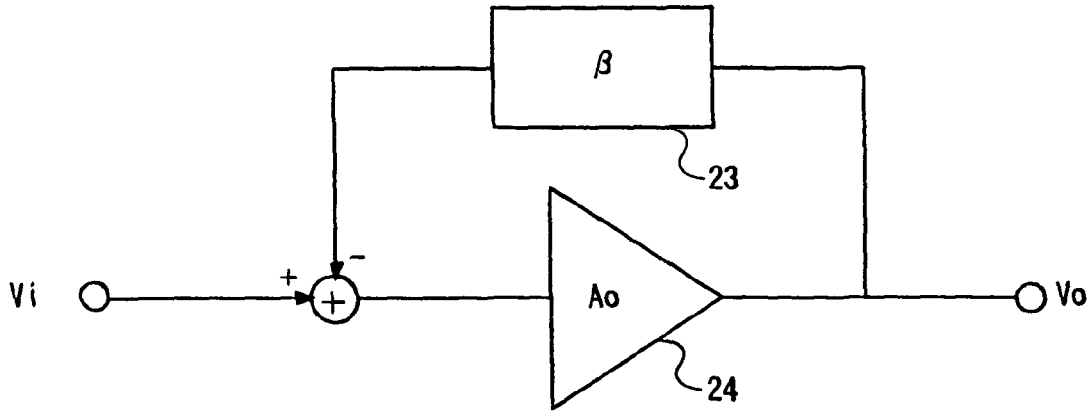
FIG. 5 is a basic block diagram of the conventional feedback circuit.
Figure 6:
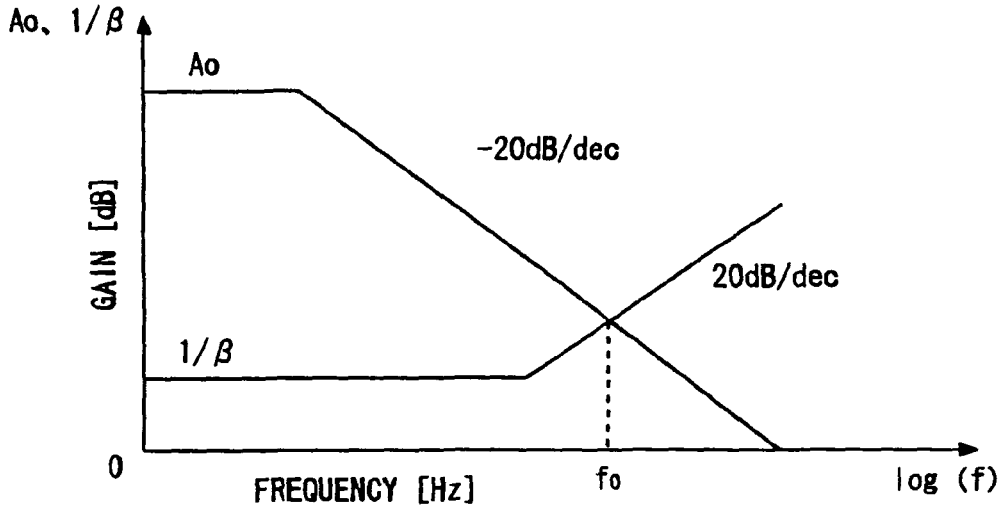
FIG. 6 RELATED ART
FIG. 6 is a Bode diagram illustrating the frequency characteristic of the conventional feedback circuit.
Figure 7:
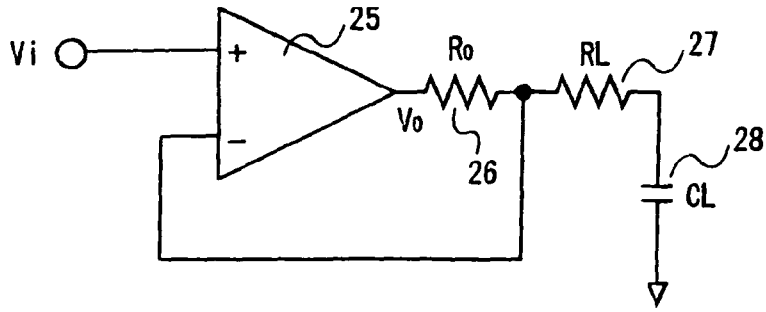
FIG. 7 RELATED ART
FIG. 7 is a block diagram illustrating the configuration example of the conventional feedback circuit.
Figure 8:
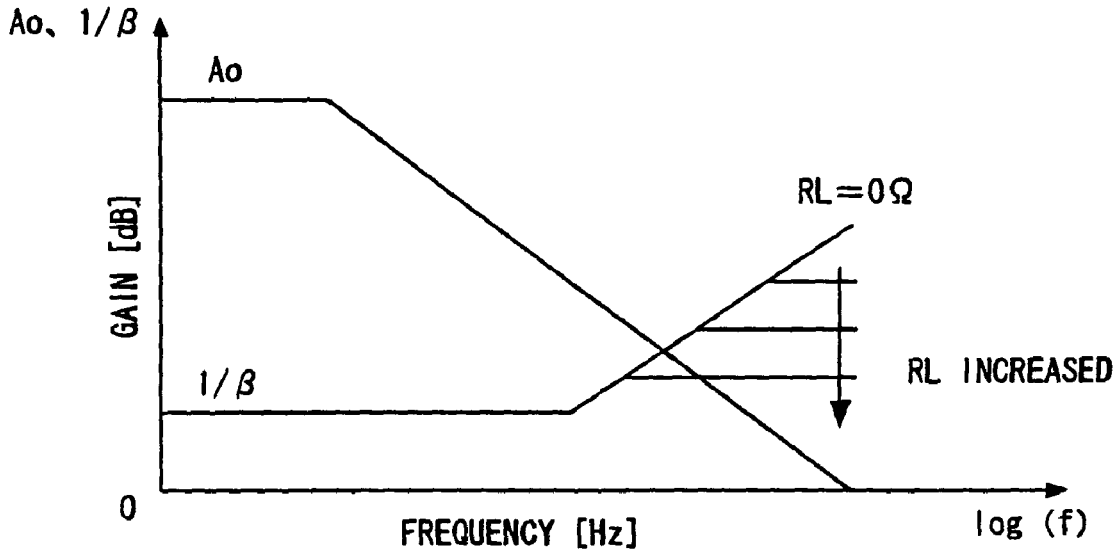
FIG. 8 RELATED ART
FIG. 8 is a Bode diagram illustrating the frequency characteristic of the conventional feedback circuit.

The configuration of the drive circuit of Embodiment 2 of the present embodiment will be described below with reference to FIG. 4. FIG. 4 shows a circuit diagram illustrating the configuration of the drive circuit of the present embodiment. This drive circuit, similarly to that shown in FIG. 1 and FIG. 2, comprises an operational amplifier 1, an operation state detection circuit 2, and a variable resistor 3. Because the variable resistor 3 is identical to that shown in FIG. 2, it is not shown herein.

As shown in FIG. 4, the operational amplifier 1 comprises P-channel MOS transistors 44-51, N-channel MOS transistors 52-59, constant current sources 60-62, constant voltage sources 63-66, and capacitors 67, 68.

An inverting input terminal Vin(−) is connected to the gate of the N-channel MOS transistor 52, the non-inverting input terminal Vin(+) is connected to the gate of the N-channel MOS transistor 53, and the constant current source 60 is connected between the sources of the N-channel MOS transistors 52, 53 and the negative power source VSS2. The inverting input terminal Vin(−) is connected to the gate of the P-channel MOS transistor 44, the non-inverting input terminal Vin(+) is connected to the gate of the P-channel MOS transistor 45, and the constant current source 61 is connected between the sources of the P-channel MOS transistors 44, 45 and the positive power source VDD2.

The sources of the P-channel MOS transistors 46, 47 are connected to the positive power source VDD2 and the gates thereof are connected to each other. The drain of the P-channel MOS transistor 46 is connected to the drain of the N-channel MOS transistor 52 via a node A, and the drain of the P-channel MOS transistor 47 is connected to the drain of the N-channel MOS transistor 53 via a node B.

The source of the P-channel MOS transistor 48 is connected to the drain of the P-channel MOS transistor 46, the drain thereof is connected to the gates of the P-channel MOS transistors 46, 47, and the gate thereof is connected to the gate of the P-channel MOS transistor 49, wherein the gate thereof is biased lower than the potential of the positive power source VDD2 by the constant voltage of the constant voltage source 64. The source of the P-channel MOS transistor 49 is connected to the drain of the P-channel MOS transistor 47 and the gate thereof is biased lower than the potential of the positive power source VDD2 by the constant voltage of the constant voltage source 64, similarly to the P-channel MOS transistor 48.

The sources of the N-channel MOS transistors 54, 55 are connected to the negative power source VSS2, and the gates thereof are connected to each other. The drain of the N-channel MOS transistor 54 is connected to the drain of the P-channel MOS transistor 44 via a node C, and the drain of the N-channel MOS transistor 55 is connected to the drain of the P-channel MOS transistor 45 via a node D.

The source of the N-channel MOS transistor 56 is connected to the drain of the N-channel MOS transistor 54, the drain thereof is connected to the gates of the N-channel MOS transistors 54, 55, and the gate thereof is connected to the gate of the N-channel MOS transistor 57, wherein the gate thereof is biased higher than the potential of the negative power source VSS2 by the constant voltage of the constant voltage source 66. The source of the N-channel MOS transistor 57 is connected to the drain of the N-channel MOS transistor 55 and the gate thereof is biased higher than the potential of the negative power source VSS2 by the constant voltage of the constant voltage source 66, similarly to the N-channel MOS transistor 56.

The constant current source 62 is connected between the drain of the P-channel MOS transistor 48 and the drain of the N-channel MOS transistor 56, the source of the P-channel MOS transistor 50 is connected to the drain of the P-channel MOS transistor 49, the gate thereof is biased lower than the potential of the positive power source VDD2 by the constant voltage of the constant voltage source 63, and the drain thereof is connected to the drain of the N-channel MOS transistor 57. The source of the N-channel MOS transistor 58 is connected to the drain of the N-channel MOS transistor 57, the gate thereof is biased lower than the potential of the negative power source VSS2 by the constant voltage of the constant voltage source 65, and the drain thereof is connected to the drain of the P-channel MOS transistor 49.

The source of the P-channel MOS transistor 51 is connected to the positive power source VDD2, the gate thereof is connected to the drain of the P-channel MOS transistor 49, and the drain thereof is connected to the output terminal Sout. The source of the N-channel MOS transistor 59 is connected to the negative power source VSS2, the gate thereof is connected to the drain of the N-channel MOS transistor 57, and the drain thereof is connected to the output terminal Sout.

The capacitance 67 is connected between the drain of the P-channel MOS transistor 47 and the output terminal Sout, and the capacitance 68 is connected between the drain of the N-channel MOS transistor 55 and the output terminal Sout.

The operation state detection circuit 2 has a configuration identical to that shown in FIG. 2. Here, a first inverter 15, a first two-input AND 16, a first two-input NOR 17, and a second inverter 18 constitute a control circuit. The gate PG of the P-channel MOS transistor 51 is connected to the gate of the P-channel MOS transistor 11 of the operation state detection circuit 2, and the gate NG of the N-channel MOS transistor 59 is connected to the gate of the N-channel MOS transistor 12 of the operation state detection circuit 2.

The drive circuit of the present embodiment operates according to the operation principle identical to that of the drive circuit shown in FIG. 2. The P-channel MOS transistor 51 is an element identical to the P-channel MOS transistor 9 shown in FIG. 2, the N-channel MOS transistor 59 is an element identical to the N-channel MOS transistor 10 shown in FIG. 2, the capacitance 67 is an element identical to the capacitance 7 shown in FIG. 2, the capacitance 68 is an element identical to the capacitance 8 shown in FIG. 2, the P-channel MOS transistor 50 and N-channel MOS transistor 58 are the elements identical to the AB-grade control circuit 6 shown in FIG. 2, the N-channel MOS transistors 52, 53 and the constant current power source 60 are the elements identical to the first differential amplifier 4 shown in FIG. 2, and the P-channel MOS transistors 44, 45 and the constant current power source 61 are the elements identical to the second differential amplifier 5 shown in FIG. 2. As for other components, the balance between electric currents flowing in the P-channel MOS transistor 51 and N-channel MOS transistor 59 is achieved by adding the output current of the N-channel MOS transistors 52, 53 and the output currents of the P-channel MOS transistors 44, 45.

Thus, the operation state detection circuit in accordance with the present invention is applicable to all the operational amplifiers having a push-pull output circuit such as shown in FIG. 2 or FIG. 4 and allows reduced power consumption, improved drive performance, and higher density in the operational amplifiers having a push-pull output circuit. For example, if the operational amplifier has gate driven transistors in the output stage, the operation state depending on the fluctuations of load conditions can be similarly detected with the operation state detection-circuit and the resistance value of the variable resistor can be changed.

As described hereinabove, inventing an operational amplifier having means for automatically detecting the operation state for each output of the drive circuit and controlling the output resistance and designed to correspond to load conditions driven by driving circuits that were diversified in recent years makes it possible to reduce the design margin of the conventional too high performance operational amplifiers. Therefore, characteristics of the conventional operational amplifiers, such as power consumption, drive performance, and degree of integration, can be greatly improved.

Further, in the above-described embodiment, there were two resistance values to be switched by the variable resistor 3 because the operation state of the operational amplifier could be a stationary state and a load drive state, but this number is not limiting and any number of resistance values may be used. When a larger number of resistance values is used, a finer adjustment of the resistance value is possible, but the configuration of the operation state detection circuit becomes complex and the circuit surface area increases.

Further, in the above-described example, the drive circuit in accordance with the present invention was used in the output circuit provided in a data line drive circuit of a liquid-crystal display panel, but this application is not limiting, and the drive circuit in accordance with the present invention may be employed in other circuits, provided they are designed for driving a capacitive load. For example, it may be used for a scanning line drive circuit of a liquid-crystal display panel or a drive circuit of an organic EL display device.

What is claimed is:

1. A display drive circuit for driving a capacitive load representing a pixel, comprising:

an amplification circuit for amplifying an input signal and outputting an amplified signal to the capacitive load;

an operation state detection circuit for detecting an operation state of an output operation to the capacitive load in the amplification circuit and outputting a detected operation state control signal; and a variable resistor connected between the amplification circuit and the capacitive load and comprising a resistance value which changes according to the detected operation state control signal.

2. The drive circuit according to claim 1, wherein the operation state detection circuit detects whether the operation state of the amplification circuit comprises a drive state in which the capacitive load is charged or discharged, or comprises a non-drive state in which the capacitive load is neither charged nor discharged.

3. The drive circuit according to claim 2, wherein the amplification circuit comprises an output-stage transistor for outputting the output signal of the amplification circuit, and the operation state detection circuit refers to a control signal of the output-stage transistor and detects the operation state based on a reference signal.

4. The drive circuit according to claim 3, wherein the operation state detection circuit detects the drive state when the reference signal is greater than a prescribed reference value, and detects the non-drive state when the reference signal is less than the prescribed reference value.

5. The drive circuit according to claim 3, wherein the variable resistor decreases the resistance value when the detected operation state comprises the drive state, relative to the resistance value of when the detected operation state comprises the non-drive state.

6. The drive circuit according to claim 2, wherein the amplification circuit comprises an output-stage transistor for putting out the amplified signal of the amplification circuit, and the operation state detection circuit refers to a control signal of the output-stage transistor and detects the operation state based on an electric current corresponding to a reference signal.

7. The drive circuit according to claim 6, wherein the operation state detection circuit detects the drive state when the electric current corresponding to the reference signal is greater than a prescribed reference value, and detects the non-drive state when the electric current corresponding to the reference signal is less than the prescribed reference value.

8. The drive circuit according to claim 6, wherein the variable resistor decreases the resistance value when the detected operation state comprises the drive state, relative to the resistance value of when the detected operation state comprises the non-drive state.

9. The drive circuit according to claim 2, wherein the variable resistor decreases the resistance value when the detected operation state comprises the drive state, relative to the resistance value of when the detected operation state comprises the non-drive state.

10. The drive circuit according to claim 2, wherein the variable resistor increases the resistance value when the detected operation state comprises the non-drive state, relative to the resistance value of when the detected operation state comprises the drive state.

11. The drive circuit according to claim 1, wherein the amplification circuit comprises an output-stage transistor for outputting an output signal of the amplification circuit, and the operation state detection circuit refers to a control signal of the output-stage transistor and detects the operation state based on a reference signal.

12. The drive circuit according to claim 11, wherein the reference signal comprises a current input to the amplification circuit.

13. The drive circuit according to claim 1, wherein the amplification circuit comprises an output-stage transistor for putting out the amplified signal of the amplification circuit, and the operation state detection circuit refers to a control signal of the output-stage transistor and detects the operation state based on an electric current corresponding to a reference signal.

14. The drive circuit according to claim 1, wherein the amplification circuit comprises an output-stage transistor for putting out the amplified signal of the amplification circuit, and the operation state detection circuit refers to the output signal of the output-stage transistor and detects the operation state based on a reference signal.

15. The drive circuit according to claim 1, wherein the amplification circuit comprises an output-stage transistor for putting out the amplified signal of the amplification circuit, and the operation state detection circuit comprises:

an output reference transistor for receiving a control signal for the output-stage transistor;

a comparator for comparing a current value of the output reference transistor and a prescribed reference value; and a resistance control output circuit for outputting a resistance control signal for controlling the resistance value of the variable resistor based on the output of the comparator.

16. The drive circuit according to claim 15, wherein the amplification circuit further comprises:

a differential amplifier in a stage prior to the output-stage transistor, wherein an output of the output-stage transistor is fed back to the differential amplifier.

17. The drive circuit according to claim 15, wherein the variable resistor comprises a plurality of transistors comprising different resistance values, and switches ON/OFF a transistor selected from the plurality of transistors and changes the resistance value based on the resistance control signal from the operation state detection circuit.

18. The drive circuit according to claim 1, wherein the amplification circuit comprises a first output-stage transistor and a second output-stage transistor in a push-pull circuit outputting the amplified signal of the amplification circuit, and the operation state detection circuit comprises:

a first output reference transistor for receiving a control signal for the first output-stage transistor;

a first comparator for comparing a current value of the first output reference transistor with a first reference value;

a second output reference transistor for receiving a control signal for the second output-stage transistor;

a second comparator for comparing a current value of the second output reference transistor with a second reference value; and a resistance control output circuit for outputting a resistance control signal for controlling the resistance value of the variable resistor based on an output of the first comparator and an output of the second comparator.

19. The drive circuit according to claim 18, wherein the amplification circuit further comprises:

a first differential amplifier in a stage prior to the first output-stage transistor; and a second differential amplifier in a stage prior to the second output-stage transistor, wherein the outputs of the first and second output-stage transistors are fed back to the first and second differential amplifiers.

20. The drive circuit according to claim 18, wherein the variable resistor comprises a plurality of transistors comprising different resistance values, and switches ON/OFF a transistor selected from the plurality of transistors and changes the resistance value based on the resistance control signal from the operation state detection circuit.

21. A display device comprising:

a display panel comprising a plurality of pixels and a plurality of lines for transmitting a plurality of signals to the plurality of pixels; and a plurality of drive circuits connected to the plurality of lines for outputting a plurality of signals to the plurality of pixels, wherein each of the plurality of drive circuits comprises:

an amplification circuit for amplifying an input signal and outputting an amplified signal to a pixel of the plurality of pixels via a line of the plurality of lines;

an operation state detection circuit for detecting an operation state of an output operation of the amplification circuit to a capacitive load of the pixel and outputting a detected operation state control signal; and a variable resistor connected between the amplification circuit and the pixel and comprising a resistance value which changes according to the detected operation state control signal.

* * * * *